US008839596B2

(12) United States Patent
Schiller et al.

(10) Patent No.: US 8,839,596 B2
(45) Date of Patent: Sep. 23, 2014

(54) LABEL REMOVER FOR REMOVING LABELS FROM BOTTLES

(75) Inventors: Iris Schiller, Holzwickede (DE); Jan Nielebock, Dortmund (DE); Bernd Molitor, Worms (DE); Falk Dittrich, Essen (DE)

(73) Assignee: KHS GmbH, Dortmund (DE)

( * ) Notice: Subject to any disclaimer, the term of this patent is extended or adjusted under 35 U.S.C. 154(b) by 263 days.

(21) Appl. No.: 12/249,415

(22) Filed: Oct. 10, 2008

(65) Prior Publication Data

US 2009/0255603 A1 Oct. 15, 2009

Related U.S. Application Data

(63) Continuation-in-part of application No. PCT/EP2007/002994, filed on Apr. 3, 2007.

(30) Foreign Application Priority Data

Apr. 13, 2006 (DE) ..... 10 2006 017 407

(51) Int. Cl.

| | |
|---|---|
| ***B65B 7/28*** | (2006.01) |
| ***B08B 9/08*** | (2006.01) |
| ***B08B 7/00*** | (2006.01) |
| ***B08B 9/30*** | (2006.01) |
| ***B08B 9/34*** | (2006.01) |

(52) U.S. Cl.

CPC ..... *B08B 9/083* (2013.01); *B65B 7/2878* (2013.01); *B08B 7/0071* (2013.01); *B08B 9/30* (2013.01); *B08B 9/34* (2013.01)

USPC ..... 53/471; 53/376.6

(58) Field of Classification Search

CPC .... B65B 7/2878; B65B 43/44; B65B 31/003; B65B 7/285; B65B 7/2807; B65B 69/00; B65B 9/14

USPC ..... 53/471, 470, 485, 487, 488, 381.1, 53/376.6, 285, 266.1, 376.8

See application file for complete search history.

(56) References Cited

U.S. PATENT DOCUMENTS 4,033,804 A * 7/1977 Baldyga ..... 156/84
4,325,775 A * 4/1982 Moeller ..... 156/584

(Continued)

FOREIGN PATENT DOCUMENTS

DE 24 60 175 7/1976
DE 2460175 7/1976

(Continued)

OTHER PUBLICATIONS

International Preliminary Report on Patentability PCT/EP2007/002994 and English translation thereof.

(Continued)

*Primary Examiner* — Sameh Tawfik

(74) *Attorney, Agent, or Firm* — Nils H. Ljungman & Associates

(57) ABSTRACT

Label remover for removing labels from bottles. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 5 Drawing Sheets

(56) References Cited

U.S. PATENT DOCUMENTS

| | | | | | |
|---|---|---|---|---|---|
| 4,715,920 | A | | 12/1987 | Ruppman et al. | |
| 4,834,826 | A | * | 5/1989 | Abe et al. | 156/344 |
| 5,123,993 | A | * | 6/1992 | Wiggins | 156/584 |
| 5,317,794 | A | * | 6/1994 | Lerner et al. | 29/426.3 |
| 5,466,325 | A | * | 11/1995 | Mizuno et al. | 156/344 |
| 5,651,846 | A | | 7/1997 | Hurst | |

FOREIGN PATENT DOCUMENTS

| | | | |
|---|---|---|---|
| DE | 30 06 490 | | 8/1981 |
| DE | 85 06 654 | | 5/1985 |
| DE | 4337130 | | 5/1994 |
| DE | 19720159 | | 11/1998 |
| DE | 103 32 443 | | 2/2005 |
| JP | 60186307 | U | 12/1985 |
| JP | 63199784 | A | 8/1988 |
| JP | 2086882 | A | 3/1990 |
| JP | 04 349 983 | | 12/1992 |
| JP | 04 350 893 | | 12/1992 |
| JP | 4350892 | A | 12/1992 |
| JP | 4350893 | A | 12/1992 |
| JP | 6198264 | | 7/1994 |
| JP | 06 343 937 | | 12/1994 |
| JP | 6343937 | | 12/1994 |
| JP | 7016553 | A | 1/1995 |
| JP | 08 215 656 | | 8/1996 |
| JP | 2000167504 | | 6/2000 |

OTHER PUBLICATIONS

International Search Report PCT/EP2007/002994 and English translation thereof.
English translation of Japanese Office Action 2009-504612.

* cited by examiner

LABEL REMOVER FOR REMOVING LABELS FROM BOTTLES

CONTINUING APPLICATION DATA

This application is a Continuation-In-Part application of International Patent Application No. PCT/EP2007/002994, filed on Apr. 3, 2007, which claims priority from Federal Republic of Germany Patent Application No. 10 2006 017 407.0, filed on Apr. 13, 2006. International Patent Application No. PCT/EP2007/002994 was pending as of the filing date of this application. The United States was an elected state in International Patent Application No. PCT/EP2007/002994.

BACKGROUND

1. Technical Field

The present application relates to a label remover for removing labels from bottles, and a method for treatment of bottles or containers as well as a device used in the method.

2. Background Information

Background information is for informational purposes only and does not necessarily admit that subsequently mentioned information and publications are prior art.

On some types of bottle cleaning machines, an accumulator and/or infeed area of the conveyor device that feeds the bottles can be located at the bottle inlet of the cleaning machine in the form of a liquid bath, in which the bottles are immersed over a portion of their height to reduce the acoustical emissions caused by the bottles banging into one another in the accumulator or infeed area. While in this liquid bath, the bottles are simultaneously or substantially simultaneously sprayed with water by means of at least one spray head or nozzle head which is located above the path of movement of these bottles.

But problems occur in the cleaning of bottles or similar containers in bottle or container cleaning machines, such as when the containers to be cleaned carry self-adhesive labels made of paper, plastic or a compound material. Such labels are difficult to remove from the individual container and also have the major disadvantage that when they are removed they generally crumple or curl up. Consequently, not only is the removal of these labels interfered with by the bottles contained in the bottle cells of the bottle baskets of a cleaning machine, and especially when the cross section of these bottle cells is fitted relatively tightly to the outside cross section of the bottles, but it also makes even more difficult the removal of the detached but partly or completely curled or crumpled labels from the bottle cells, specifically on account of the tight spatial conditions in the bottle cells, and on account of the fact that the labels still have some of their self-adhesive characteristics, at least to some extent. At least parts of some of the labels are therefore carried into the cleaning machine by the bottle cells.

In other words, in some beverage bottle cleaning machines there is a plurality of individual bottle holders or cells. These cells may be substantially box-shaped or shaped to follow the contours of the bottles that they hold. In operation, bottles are fed into the cells, one bottle for each cell, at an inlet section and are then conveyed inside the cells through the cleaning machine. Because of the relatively tight spacing inside each cell, it may be difficult to remove the labels from the bottles and then remove the labels from the cell itself. The labels could crumple or curl up inside the cell, or stick to the cell walls because of the adhesive on the labels. As a result, the cells could become blocked up or cluttered with label pieces and/or the cleaning machine itself could be cluttered with label pieces.

To promote the removal of the labels from the bottle cells, it is in many cases desirable to increase the dimensions of the bottle cells, as a result of which, given the same dimensions of a cleaning machine, the cleaning capacity of the machine (bottles cleaned per unit of time) is significantly reduced.

To be able to remove the self-adhesive labels, it is also desirable to increase the label removal capacity which is conventionally present in a cleaning machine and works with a high-volume flow of bottles, which could possibly require at least an increased motor power and additional energy consumption.

OBJECT OR OBJECTS

The object of the present application is to create a method with which such disadvantages can be overcome. To accomplish this object, the present application teaches a method for the treatment of bottles or similar containers in which the external surfaces of the containers are treated in at least one treatment zone with a treatment medium. For the removal of the labels that are adhering to the containers and possibly for the removal of self-adhesive labels, the containers are warmed or heated prior to the treatment using the treatment medium in a bottle cleaning machine having a known construction in an independent treatment phase. The performance of the method is an object of a device for the treatment of at least the external surfaces of bottles or similar containers with a treatment medium and with at least one treatment zone. The containers are moved through at least one treatment zone on a conveyor. The device for the removal of labels and possibly of self-adhesive labels is provided and may be realized in the form of an independent unit.

SUMMARY

The present application teaches that before the containers are introduced into the actual container cleaning machine, such as generally described herein, for example, they are treated so that at least the greater portion of the self-adhesive label is removed from the containers. For this purpose the containers and thereby possibly also the self-adhesive glue layer between the containers and the labels are heated in a pretreatment phase so that the self-adhesive glue layer of the respective label is converted by the heating into a soft or at least viscous state, so that the labels can be completely or at least partially removed from the containers in a subsequent main treatment phase with the treatment medium used in this treatment phase.

In the main treatment phase, for example, the containers are treated or subjected to a surge-type jet of a heated liquid treatment medium and/or are sprayed with a heated treatment medium that is discharged, for example, from nozzles at high pressure, and possibly so that the jets of the treatment medium strike the external surface of the container tangentially or approximately tangentially or at an acute angle, so that the labels can be peeled off by these high-pressure jets.

Some possible advantages of at least one possible embodiment of the method and/or the device disclosed herein may be, among other things, as follows:

The labels are removed safely and reliably.

The major portion of the labels therefore would be restricted or substantially prevented from entering into the cleaning machine. As a result, the useful life of the cleaning media, possibly including caustic cleaning agents, used in the cleaning machine may possibly be increased significantly or substantially, and the consumption of cleaning medium and chemicals may possibly be reduced significantly or substantially.

The amount of waste water produced may possibly also be diminished, which could possibly result in a simultaneous reduction of costs for the cleaning process.

As a result of the method according to at least one possible embodiment, the capacity and the space requirements of the means for the removal of the label to be provided in a cleaning machine and for the outward transfer of removed labels are possibly reduced.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Developments of the present application are described herein according to at least one possible embodiment of the present application. The present application is described below in greater detail with reference to the possible embodiments illustrated in the accompanying figures, in which.

DESCRIPTION OF EMBODIMENT OR EMBODIMENTS

In the figures, bottles 1 or similar containers are shown which are provided in an area of the container with a self-adhesive label 2 made of paper, plastic or a compound material.

Figure 1:
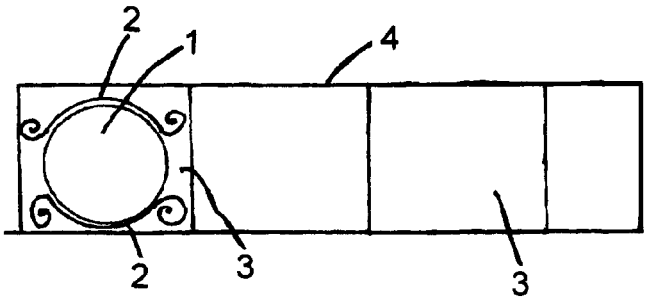
FIG. 1 shows, in a simplified schematic illustration, the bottle cell of a bottle cleaning machine together with a bottle located in this cell with a self-adhesive label that has been partly removed.
Figure 2:
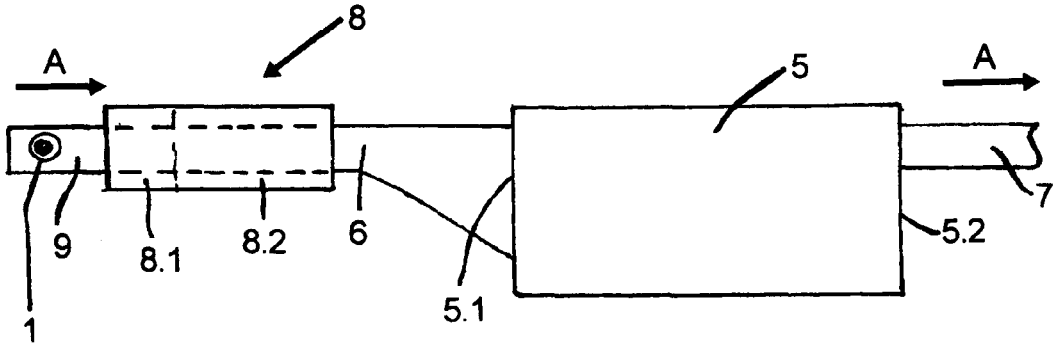
FIG. 2 shows, in a simplified illustration and in a plan view, a plant for the cleaning of bottles or similar containers comprising a bottle washing machine and an upstream machine or device for the removal of the labels.

FIG. 1 shows, in a very simplified illustration, a bottle basket 4 of a bottle or container cleaning machine 5, which bottle basket 4 has a plurality of bottle cells 3 in which the bottles 1 that are fed via a conveyor line 6 are transported for cleaning from a container inlet 5.1 through various cleaning zones to a container outlet 5.2, from which the cleaned bottles 1 are then fed via a conveyor line 7 for further use (FIG. 2).

As indicated in FIG. 1, the self-adhesive labels 2 tend to come detached from the bottles 1 in the cleaning machine 5 or in the treatment zones located in the cleaning machine by a curling of the label edges. As a result of this curling, the removal of the labels from the bottles 1 and from the bottle cells 3 is restricted or hindered, as described above.

To overcome these above mentioned disadvantages, upstream of the cleaning machine 5 there is a device 8 for the removal of the labels 2 from the bottles 1. The device 8 comprises two sections 8.1 and 8.2. Section 8.1 is for the separation of the bottles 1 which are fed upright by means of a conveyor 9, i.e. with their bottle axis oriented in the vertical direction. Section 8.2 is a section in which the labels 2 are removed by heating and, for example, by rinsing and/or lateral spraying (including with high-pressure water and/or steam jets), so that the bottles 1 from which the labels 2 have been removed can then travel via the conveyor line 6 to the container inlet 5.1 of the cleaning machine 5.

Figure 3:
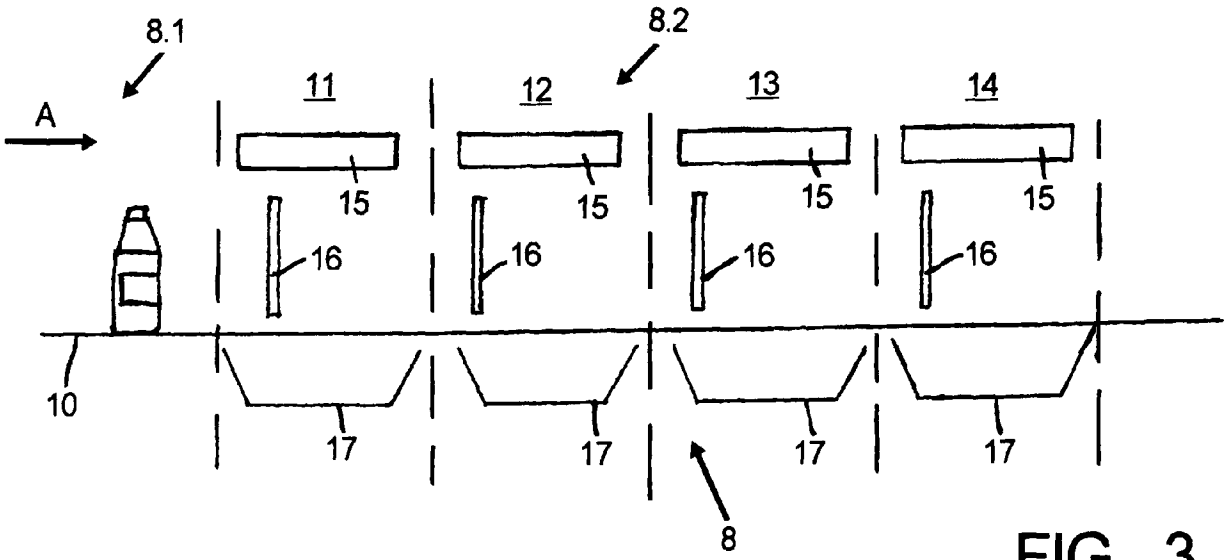
FIG. 3 shows, in a simplified schematic illustration, one possible embodiment of the device according to the present application.
Figure 4:
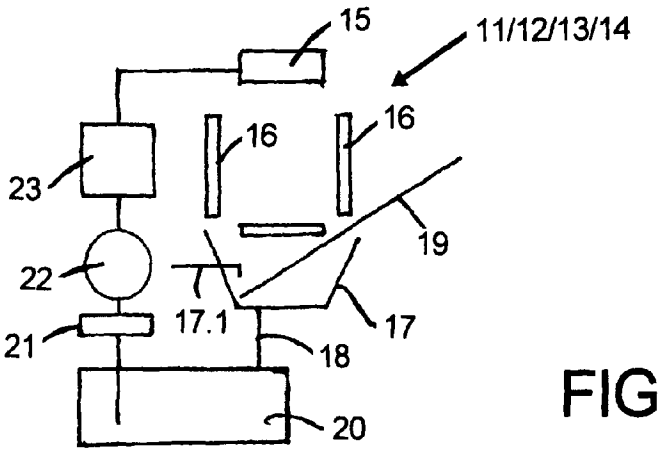
FIG. 4 shows, in cross section, a station of the device for the removal of the labels.

FIGS. 3 and 4 show the device 8 in greater detail and in particular its section 8.1. A conveyor 10 is inside the device, by means of which the bottles 1 are moved through the section 8.1, and then, in the stream of bottles standing upright and at some distance from one another, are moved through the section 8.2. The section 8.2 comprises a plurality of sub-sections, and specifically in the illustrated exemplary embodiment a total of four sub-sections or treatment zones 11 to 14. However, it should be understood that other possible embodiments could have more or fewer sub-sections.

In the treatment zones 11 and 12, there is respectively a pre-heating or warming of the bottles 1 (pre-treatment phase), and specifically also so that as a result of this warming, the glue layer of the labels 2 is softened so that the warmed labels can be removed more easily. To warm the bottles 1, they are treated with hot water in the treatment zones 11 and 12 from above, as well as from the side. For this purpose, in the treatment zones 11 and 12, above the path of movement of the bottles 1 and to the side of this path of movement, there are nozzle heads 15 and 16 respectively, each of which is provided with a plurality of nozzle openings from which the hot water is discharged onto the bottles 1 as they move past.

Below the conveyor 10, in each treatment zone 11 and 12 there is a water collecting basin 17 with a corresponding drain 18. Inside the basin 17 is a screen, for example a screen 19 formed by a circulating traveling screen, which removes foreign matter and/or solid components, for example labels 2 that have already been removed in the treatment zones 11 and 12, and transports them outward. The water which travels via the drain 18 into a collecting chamber 20 is recycled from the collecting chamber 20 via a screen 21, a pump 22, and a heater 23 to the nozzle heads 15 and 16. A valve-controlled water feed device 17.1 is provided to make up the water lost during the outward transfer of the foreign matter via the screen 19.

The bottles 1 heated in the treatment zones 11 and 12 and/or in the pre-treatment phase are then rinsed with hot water (main treatment phase) in the downstream treatment zones 13 and 14. For this purpose, the treatment zones 13 and 14 have generally the same construction as was described for the treatment zones 11 and 12, although with the difference that the amount of water discharged onto the bottles 1 during this rinsing is greater than the amount of water used during the heating of the bottles 1 in the treatment zones 11 and 12, and the nozzle heads 15 and 16 have larger nozzle openings. The water used for the rinsing is at a temperature that is just below the boiling point, e.g. a temperature of approximately ninety-five degrees Celsius, or possibly approximately in the range of between ninety and one hundred degrees Celsius. It has been shown that at this water temperature, the labels 2 can generally be removed from the bottles 1 in possibly a few seconds, for example in a maximum of 10 seconds, and can then be removed by means of the screens 19 formed by rotating traveling screens or similar outward transfer devices that are provided in the treatment zones 12 and 13.

The device 8 and thereby in particular also its section 8.2 are realized in a modular fashion, i.e. the individual treatment zones 11 to 14 are each realized identically or largely identically in the manner described above and can be combined as desired into the device 8. In at least one possible embodiment the number of modules or treatment zones used for the pretreatment and/or preheating of the bottles 1 and/or for the removal of the labels 2 (main treatment) can be adapted to the individual application.

In the above explanation it was assumed that in the treatment zones 11 and 12, the bottles 1 are heated by hot water. Other methods are also possible. For example, the bottles 1 and/or the self-adhesive layer of the labels 2 can also be heated by other hot media in the form of gas, vapor and/or liquid, possibly also by steam or hot air, thereby making it possible to remove the labels in the treatment zones 13 and 14. Other options for the preheating of the bottles 1 include, for example, infrared radiation and/or treatment with electromagnetic waves (microwaves). The treatment with electromagnetic waves may be used when the glue layer of the self-adhesive labels 2 contains an electrically conductive addition or filler, so that during the preheating by microwave radiation, essentially only this glue layer is heated to liquefy or soften the glue.

In the above explanation, it was further assumed that the labels are removed in the treatment zones 13 and 14 by a surge-type jet of hot water. Here, too, there are other options, such as, for example, the labels can be removed by spraying or peeling the labels 2 off from the side by means of high-pressure water jets, e.g. by means of high-pressure jets of hot water, etc. In other possible embodiments, other jet or high-pressure media could be used, such as heated air or gas jets.

Figure 5:
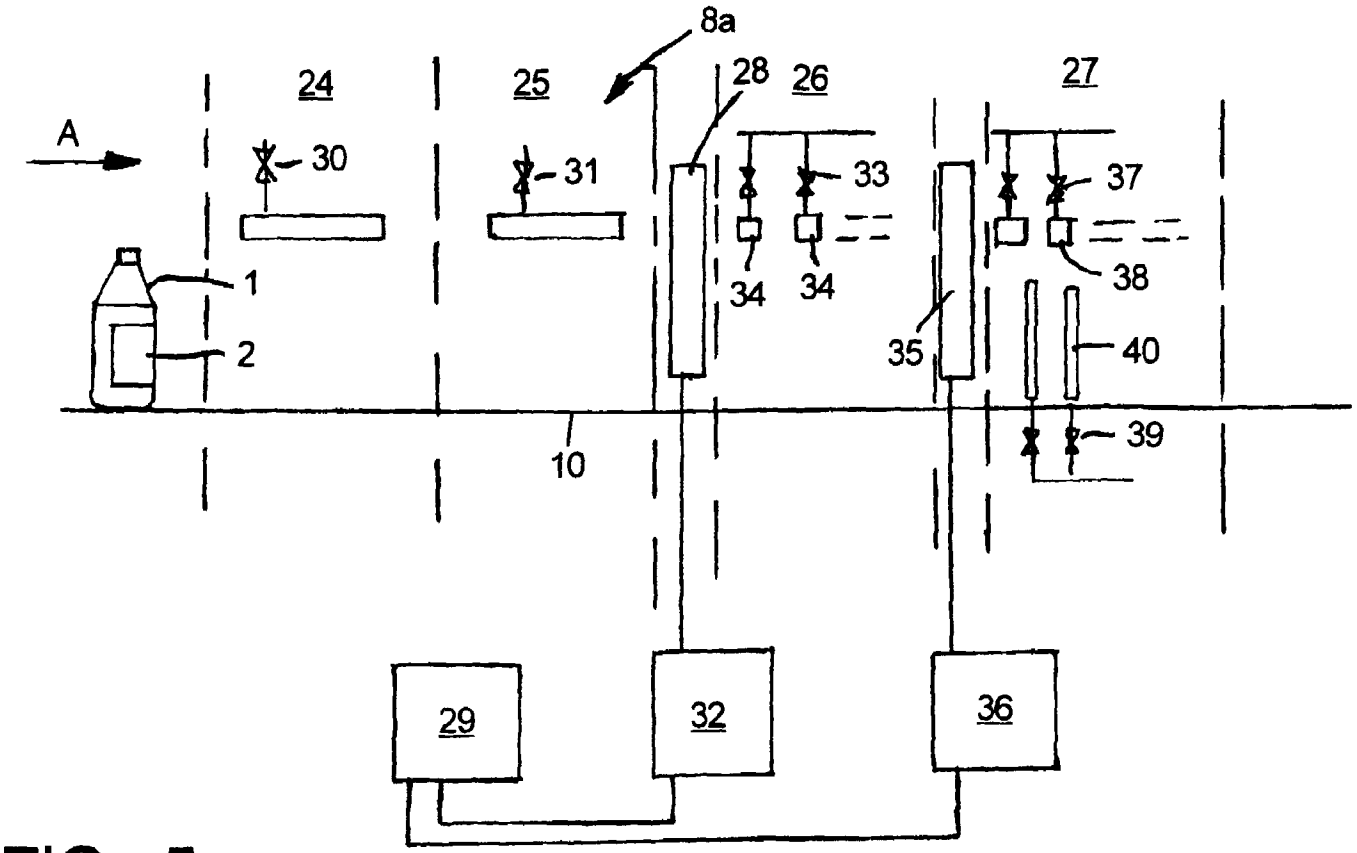
FIG. 5 shows, in an illustration like the one in FIG. 3, an additional possible embodiment of the present application.

FIG. 5 shows a device 8*a* which differs from the device 8 essentially in that the pretreatment and/or the preheating of the bottles 1 that are in turn moved by the conveyor 10 through the treatment zones 24 to 27 and are thereby kept a some distance from one another takes place in the treatment zones 24 and 25 and also in that the labels 2 are removed by rinsing and/or lateral spraying in the treatment zones 26 and 27 in a controlled manner, i.e. by a controlled discharge of the respective treatment medium. For this purpose, at the outlet of the treatment zone 25, i.e. at the transition from this treatment zone to the treatment zone 26, a sensor unit 28 is provided, for example a sensor unit which measures the temperature of the bottles 1 moving past, so that by means of a control device 29 associated with the sensor unit 28 and by the actuation of valves 30 and 31, the quantity of hot water discharged via the nozzle heads 15 can be controlled to achieve an optimum preheating of the bottles 1 with an optimized energy consumption.

If, in the treatment zones 24 and 25, the bottles 1 are heated not with hot water but, as described above, with another medium such as steam, hot air, infrared or microwave energy etc., for example, the amount of energy transferred via this medium to the bottles 1 is controlled accordingly by means of the sensor unit 28 and the control device 29. The sensor unit 28 can also have, for example, a camera system which is a component of an image processing and/or evaluation system 32, by means of which the ratio of the bottles 1 with and without labels 2 is determined and accordingly, via the control system 29 and valves 33, the quantity of hot water discharged from the nozzles 34 during the surge-type jet treatment of the bottles 1 is controlled.

An additional sensor unit 35 is provided at the transition between the treatment zones 26 and 27. This sensor unit is likewise a camera system of an image processing or image evaluation system 36, with which in turn the proportion of bottles 1 with and without labels 2 is determined. By means of the control system 29, which actuates the valves 37 in the desired manner, the nozzles 38 direct the surge-type jets against the bottles 1 in a controlled manner, and by actuation of the valves 39, the bottles 1 are sprayed from the side via the nozzles 40 and/or the labels 2 are peeled off, whereby each operation is possibly controlled as a function of the ratio of the number of bottles 1 with and without labels 2.

To further explain, in at least one possible embodiment, the sensor unit 28 has a camera which transmits image data to the image processing and/or evaluation system 32. The image data can be used to accomplish different functions in different possible embodiments. In one possible embodiment, the image data assists in regulating the temperature, amount, and rate of water being sprayed by the different sprayers 34, 38, and 40. For example, if a large portion of the labels are being removed in the preheating zones 24, 25, the valves 33, 37 in the high-pressure spraying zones 26, 27 may be actuated to reduce the amount of water sprayed in those zones as less will be necessary to remove the labels. On the other hand, the valves 30, 31 in the preheating zones 26, 27 may be actuated to reduce the amount of water sprayed in those zones as possibly too much water or heat may be in use than would be desirable as the water is removing the labels rather than simply preheating the bottles. In either case, the water flow rate and temperature could be adjusted to reduce water waste and energy costs. In another possible embodiment, the image data might show that not enough water or high enough temperatures are being used if a large portion of the labels are remaining on the bottles. Accordingly, the temperature, flow, and pressure of the water could be increased in the different zones 24-27 as desired, in a similar manner as the decreasing of the temperature, flow, and pressure discussed above. In still another possible embodiment, the image data assists in regulating the temperature, flow, and pressure of the water when mixed groups of bottles with and without labels are being cleaned in a single process. For example, if thirty percent of a group of bottles being cleaned do not have labels to start with, such unlabeled bottles obviously would not need to be treated in the same way as bottles which have labels on them that are to be removed. In such a situation, the image data will report the approximate number of unlabeled bottles that do not require the treatment provided by the zones 24-27, especially the high pressure treatment or jet spraying of zones 26, 27. The temperature, flow, and pressure of the water could thus be possibly reduced in order to not waste water and energy on bottles that do not require such treatment. In yet another possible embodiment, the cameras in the sensors 28, 35 view or look downstream, that is, sensor 28 monitors the following zone 26, and sensor 35 monitors the following zone 27. The image data can be used to detect bottles for which the labels have not been sufficiently removed to a desired level, which bottles would then be removed from the bottle line prior to entering the cleaning machine. For example, if a bottle were to pass through zone 27 and only sixty percent of the label has been removed when seventy percent removal is desired, such a bottle would be detected by the camera in the sensor unit 35, which would send the data to the processing system 32. The processing system 32 could then signal the computer control system 29, which would activate the removal device (not shown) to remove the bottle from the line and either send it out to be discarded or to be processed again through the treatment zones 24-27 for the desired level of label removal. Such data could also generate an increase in the temperature, flow, and pressure of the water if a substantial number of bottles are being removed from the line for insufficient label removal, as such would be evidence that the temperature, flow, or pressure is not sufficient to remove a sufficient amount of the labels. In at least one other possible embodiment, the cameras can be used to detect the different label types, sizes, characteristics, shapes, and locations on the bottles or containers. If, for example, a predetermined temperature, flow, or pressure of the treatment media is most suitable for labels of a particular size, such as higher pressure for larger labels or lower pressure for smaller labels, then the image data recorded regarding the size of labels being processed could be used to adjust the temperature, flow, or pressure accordingly. In general, it should be understood that the temperature, flow, or pressure of the treatment media may possibly be adjusted according to any number of label characteristics, in accordance with at least one possible embodiment.

The functions of the central control unit 29 and of the image processing and/or image evaluation system 32 and 36 are in at least one possible embodiment combined into a single control system, e.g. in a common control system that is formed at least partly by a computer.

Figures 6, 7:
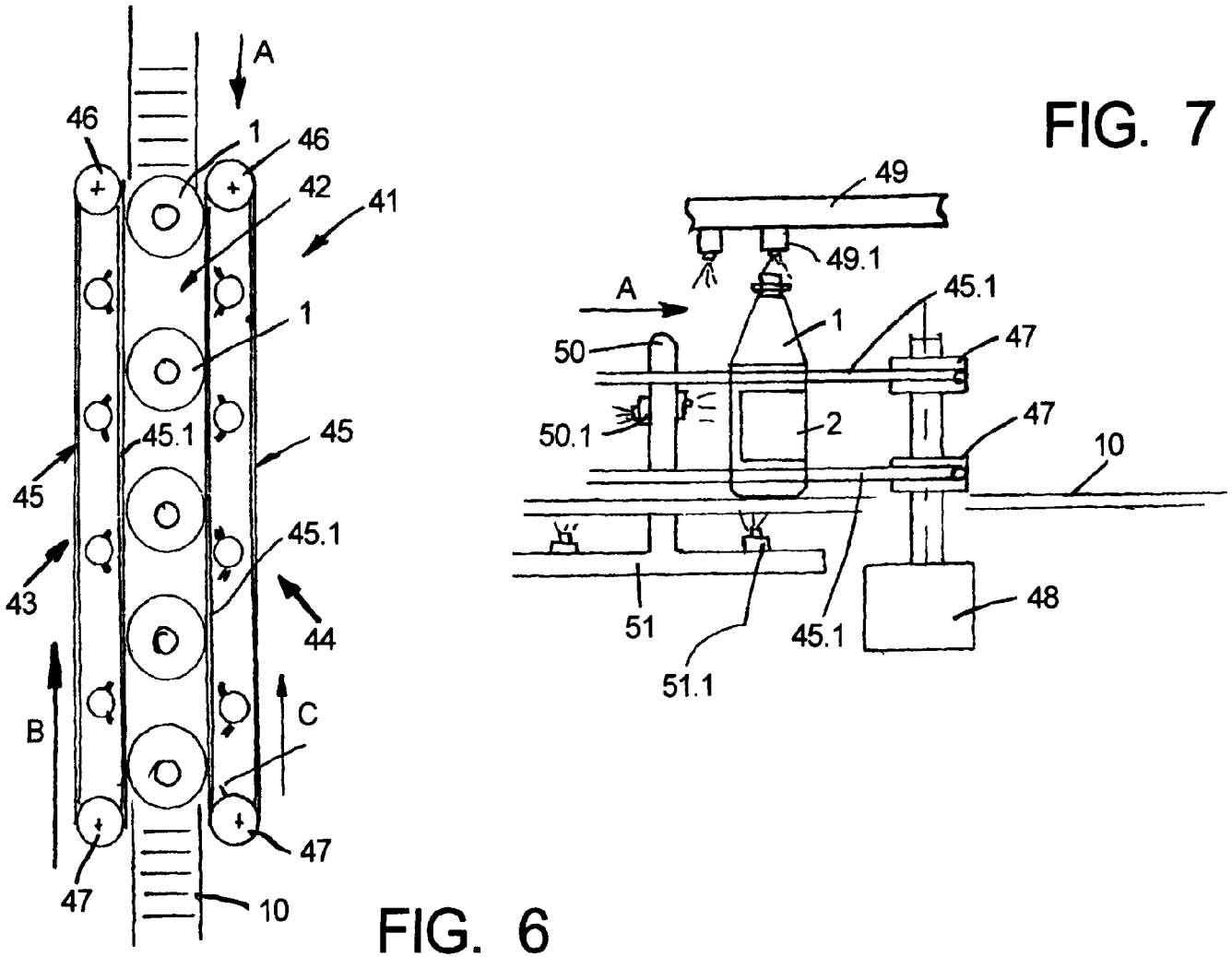
FIG. 6 shows, in a schematic illustration and in a plan view, a treatment zone of an additional possible embodiment of the present application.
FIG. 7 shows the treatment zone illustrated in FIG. 6, in a partial view from the side.

FIGS. 6 and 7 show in the form of additional possible embodiments a treatment zone 41, which like the treatment zones 11 to 14 and 24 to 27 respectively can be combined with additional treatment zones into a device for the removal of the labels 2 from the bottles 1. The treatment zone 41 in turn comprises the conveyor 10 inside the device, on which the bottles 1 in the upright position are moved through the treatment zone 41, and specifically on the conveyor line 42 formed by this conveyor 10. On both sides of the conveyor line 42 there are two clamping jaw conveyors 33 and 44, each of which is formed by two endless belts 45 that are driven in circulation, and which with their inboard lengths 45.1 form the lateral limit of the conveyor line 42 and are in lateral contact against the bottles 1, and specifically against their peripheral surface outside the labels 2 to be removed. In the illustrated embodiment, the lower belt 45 of each clamping jaw conveyor 43 and 44 is in contact over its length 45.1 against the bottles 1 in the area of the bottom of the bottle or slightly above the bottom of the bottle and the upper belt 45 is in contact over its length 45.1 against the bottles 1 on the barrel of the bottle approximately at the transition to the tapered shoulder of the bottle.

Each belt forms a closed loop which is oriented with its loop plane in a horizontal or essentially horizontal plane. Each belt 45 is further guided by two rollers 46 and 47 and by casters or guides (not shown). Of the rollers, at least the rollers 47 of each clamping jaw conveyor 43 and 44 are located on a common shaft which is driven by a drive mechanism 48. The distance between the two clamping jaw conveyors 43 and 44 and the inboard lengths 45.1 is selected so that the bottles 1 that pass through the treatment zone 41 and are held at some distance from one another are held clamped between the clamping jaw conveyors 43 and 44.

The belts of the clamping jaw conveyor 43 and the belts 45 of the clamping jaw conveyor 44 are possibly driven at different speeds, as indicated in FIG. 6 by the arrows B and C, so that the bottles 1 are rotated around their vertical bottle axis as they pass through the conveyor line 42.

Above the conveyor line 42 there are in turn nozzle heads, e.g. spray tubes 49 with nozzles 49.1 for the discharge of the respective treatment medium, i.e. when the treatment zone 41 is used for the pretreatment phase for the discharge of the pretreatment medium to warm the bottles 1 and when the treatment zone 41 is used for the main treatment phase for the discharge of the liquid treatment medium (e.g. hot water) for the final removal of the labels 2. On the conveyor line 42 there are also lateral spray tubes 50 with nozzles 50.1, with which the bottles 1 moving past are treated from the side. In at least one possible embodiment, when the conveyor zone 41 is used for the main treatment phase, the spray nozzles 50.1 are oriented so that the jets of the liquid treatment medium they emit (which can be fan-shaped jets, for example) are oriented tangentially or approximately tangentially to the periphery of the bottles 1 that are moving past. An additional spray tube 51 with a plurality of nozzles 51.1 is provided underneath the conveyor line 42 or the path of movement of the bottles 1.

As a result of the use of the clamping jaw conveyors 43 and 44 it is also possible to realize the conveyor line 42, at least over a portion of its length, without the conveyor 10 that forms the support surface for the bottles 1, so that the nozzles 51.1 provided below the conveyor line 42 can be used to their full effect.

Figure 8:
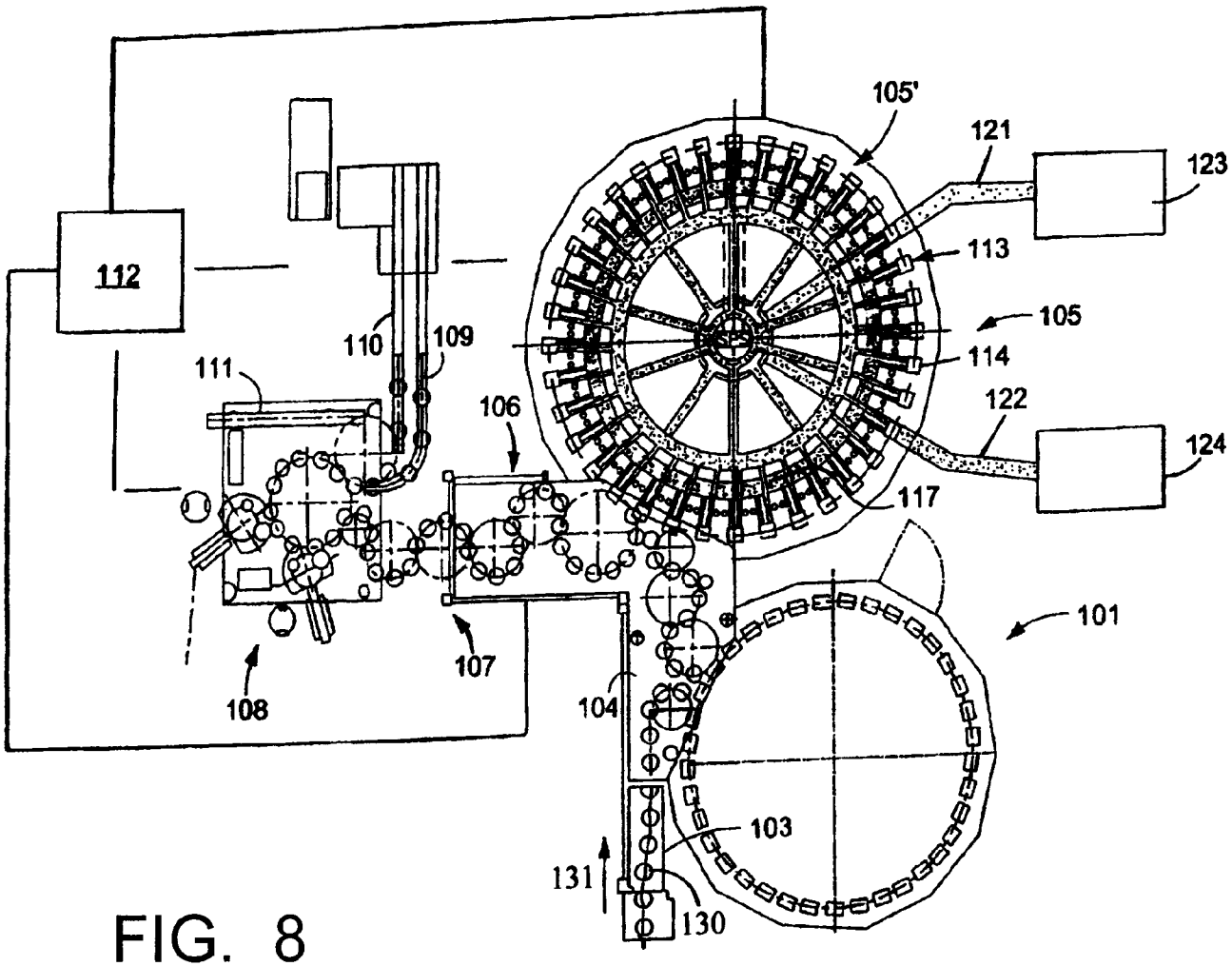
FIG. 8 shows schematically the main components of one possible embodiment example of a system for filling containers.

FIG. 8 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 8 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 8, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

The embodiments described above are possible embodiments, and thus modifications and variations can be made without thereby going beyond the teaching of the present application.

For example, it is also possible, as a function of the signals supplied by the sensor units 28 and 35, to control not the individual treatment zones 24 to 27 but the entire plant, in which case, for example, instead of two sensor units 28 and 35, only one sensor unit is provided at the container outlet of the device 8*a*.

Furthermore, for example, it is also possible to provide suitable sensors or sensor units upstream of each treatment zone, and specifically so that for each bottle 1, an individual verification is made whether one or more labels 2 are still adhering to the bottle. As a function of this verification, the capacity of the downstream treatment zone as a whole and/or the capacity of only individual functional elements, e.g. nozzles, can be controlled or regulated. This regulation process could also be carried out advantageously so that the individual treatment medium is discharged only by those nozzles in whose range of action the container in question is located.

The possible embodiments described above are for devices that are used for the treatment of bottles. It goes without saying that these devices can also be used in the same manner for other containers for the removal of self-adhesive labels. The device according to the present application can also be used not only for the removal of labels, but also for the removal of labels which have been applied to the respective bottle and/or to the respective container using another adhesive or glue.

In the possible embodiments described above, the containers or bottles 1 are moved through the various treatment zones 11 to 14 and 24 to 27 and 41 in the form of a single-file flow of containers. Of course it is also possible to realize the device so that the containers or bottles 1 are moved through the device in a multiple-file flow of bottles or containers, in which case, for example, a plurality of parallel or relatively parallel channels are formed by appropriate guide fences for the individual container flows and the individual nozzles are provided in a corresponding distribution above and/or to the side and/or underneath these channels.

The following patents, patent applications or patent publications, are hereby incorporated by reference as if set forth in their entirety herein: DE 30 06 490 A1, published on Aug. 27, 1981, and having inventors Hermann KRONSEDER and Karl DULLINGER.

The purpose of incorporating U.S. patents, foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

In a method for the treatment of bottles or similar containers in which the containers are treated with a cleaning fluid in at least one treatment zone at least on their outside surface, the bottles or containers are warmed in a pretreatment phase for the removal of labels, such as self-adhesive labels, prior to the treatment with the liquid treatment medium.

One feature or aspect of an embodiment is believed at the time of the filing of this patent application to possibly reside broadly in a method for the treatment of bottles or similar containers 1 in which the containers are treated in at least one treatment zone 13, 14; 26, 27 at least on their external surface with a treatment medium, wherein or the removal of the labels that are adhering to the containers 1, possibly for the removal of self-adhesive labels, the containers 1 are warmed or heated prior to the treatment using a treatment medium in a bottle cleaning machine having a known construction in an independent treatment phase.

Another feature or aspect of an embodiment is believed at the time of the filing of this patent application to possibly reside broadly in the method, wherein the independent treatment phase is divided into a pretreatment phase and a main treatment phase.

Yet another feature or aspect of an embodiment is believed at the time of the filing of this patent application to possibly reside broadly in the method, wherein in the pretreatment phase, the containers 1 are warmed or heated by a fluid treatment medium or by radiation energy.

Still another feature or aspect of an embodiment is believed at the time of the filing of this patent application to possibly reside broadly in the method, wherein the containers 1 are treated in the main treatment phase by a surge-type jet treatment with the heated fluid treatment medium, for example with heated water.

A further feature or aspect of an embodiment is believed at the time of the filing of this patent application to possibly reside broadly in the method, wherein in the main treatment phase, the containers are treated by high-pressure spraying with the liquid treatment medium, for example water.

Another feature or aspect of an embodiment is believed at the time of the filing of this patent application to possibly reside broadly in the method, wherein the high-pressure spraying is done with the heated liquid treatment medium, e.g. with heated water.

Yet another feature or aspect of an embodiment is believed at the time of the filing of this patent application to possibly reside broadly in the method, wherein the heated treatment medium is at a temperature in the range between 90 degrees Celsius and 100 degrees Celsius, for example at a temperature of approximately 95 degrees Celsius.

Still another feature or aspect of an embodiment is believed at the time of the filing of this patent application to possibly reside broadly in the method, wherein the containers 1, in the pretreatment phase and in the main treatment phase, are standing upright and are treated with the treatment medium from above and/or from the side.

A further feature or aspect of an embodiment is believed at the time of the filing of this patent application to possibly reside broadly in the method, wherein the treatment medium is applied to the external surface of the container for the removal of the labels 2 at least partly tangentially or at an acute angle.

Another feature or aspect of an embodiment is believed at the time of the filing of this patent application to possibly reside broadly in the method, wherein the containers 1 are warmed in the pretreatment phase by a heated fluid medium, e.g. by hot water.

Yet another feature or aspect of an embodiment is believed at the time of the filing of this patent application to possibly reside broadly in the method, wherein the containers 1 are warmed in the pretreatment phase by a hot gaseous medium, e.g. by hot air and/or steam.

Another feature or aspect of an embodiment is believed at the time of the filing of this patent application to possibly reside broadly in the method, wherein in the pretreatment phase the containers are warmed by radiation energy, e.g. by infrared or electromagnetic radiation, possibly in the microwave range.

Yet another feature or aspect of an embodiment is believed at the time of the filing of this patent application to possibly reside broadly in the method, wherein the pretreatment phase and the subsequent main treatment phase are each conducted in treatment zones 11-14; 24-27; 41, and that the containers 1 are moved through the treatment zones 11-14; 24-27; 41 by means of a conveyor element 10.

Still another feature or aspect of an embodiment is believed at the time of the filing of this patent application to possibly reside broadly in the method, wherein at least two treatment zones 11, 12, 24, 25; 13, 14, 26, 27; 41 are used for the pretreatment phase and/or the main treatment phase.

A further feature or aspect of an embodiment is believed at the time of the filing of this patent application to possibly reside broadly in the method, wherein the preheating of the containers 1 is performed in a temperature-controlled manner in the pretreatment phase.

Another feature or aspect of an embodiment is believed at the time of the filing of this patent application to possibly reside broadly in the method, wherein following the at least one treatment zone 24, 25 for the pretreatment phase there is at least one sensor 28 that measures the temperature of the containers 1 to regulate the temperature of the pretreatment.

Yet another feature or aspect of an embodiment is believed at the time of the filing of this patent application to possibly reside broadly in the method, wherein the quantity of treatment medium used in the main treatment phase is a function of the ratio "containers 1 with labels 2/containers 1 without labels 2".

Still another feature or aspect of an embodiment is believed at the time of the filing of this patent application to possibly reside broadly in the method, wherein in the direction of transport A of the containers 1, upstream of the at least one treatment zone 26, 27 for the main treatment phase, there is at least one sensor unit, for example at least one camera of an image processing or recognition system 32, 36, for the determination of the ratio "containers 1 with labels 2/containers 1 without labels 2".

A further feature or aspect of an embodiment is believed at the time of the filing of this patent application to possibly reside broadly in the method, wherein the containers 1 that are fed via the conveyor line 9 in a single-file or multi-file container flow are placed at a distance from one another in a section of the conveyor line 9 or of the device that precedes the at least one treatment zone 11, 24 for the pretreatment phase so that during the pretreatment phase and the main treatment phase, each container 1 is a distance from neighboring containers.

Another feature or aspect of an embodiment is believed at the time of the filing of this patent application to possibly reside broadly in the method, wherein the containers 1 in the treatment zone for the pretreatment phase and/or in the treatment zone for the main handling phase are held between at least two clamping jaw conveyors 43, 44, possibly for a treatment with the treatment medium from below.

One feature or aspect of an embodiment is believed at the time of the filing of this patent application to possibly reside broadly in a device for the treatment of bottles or similar containers 1 at least on their outside surface with a treatment medium, with at least one treatment zone 13, 14; 26, 27; 41, through which the containers 1 are moved on a conveyor 10, wherein the device for the removal of labels 2, possibly of self-adhesive labels, is provided and is realized in the form of an independent unit.

Another feature or aspect of an embodiment is believed at the time of the filing of this patent application to possibly reside broadly in the device, wherein inside the device on the conveyor line formed by the conveyor 10, in a direction of transport A there is at least one pretreatment zone 11, 12; 24, 25; 41 for the warming of the containers 1 and at least one main treatment zone 13, 14; 26, 27; 41.

Yet another feature or aspect of an embodiment is believed at the time of the filing of this patent application to possibly reside broadly in the device, wherein the at least one main treatment zone 13, 14; 26, 27; 41 has means 15, 16, 34, 40 for the output of a heated liquid treatment medium onto the containers 1, for example for the output of heated water.

Still another feature or aspect of an embodiment is believed at the time of the filing of this patent application to possibly reside broadly in the device, wherein in the at least one main treatment zone 13, 14; 26, 27, 41 there are nozzles 15, 16; 34, 40; 49.1, 50.1, 51.1 for the high-pressure spraying of the containers 1 with a liquid treatment medium, for example with water, possibly with a heated treatment medium or water.

A further feature or aspect of an embodiment is believed at the time of the filing of this patent application to possibly reside broadly in the device, wherein in the at least one main treatment zone there are nozzles 16, 40, 50.1 for the output of the liquid treatment medium tangentially or approximately tangentially or at an acute angle on the outer surface of the container to peel the labels 2 off the containers 1.

Another feature or aspect of an embodiment is believed at the time of the filing of this patent application to possibly reside broadly in the device, wherein the at least one pretreatment zone 11, 12; 24, 25; 41 has means 15, 16, 49.1, 50.1, 51.1 for the output of a heated liquid and/or gaseous medium, for example for the output of hot water and/or hot air and/or steam on the containers 1.

Yet another feature or aspect of an embodiment is believed at the time of the filing of this patent application to possibly reside broadly in the device, wherein the at least one pretreatment zone 11, 12; 24, 25; 41 has means for the heating of the containers 1 by radiation energy, for example by infrared and/or electromagnetic waves, possibly in the microwave range.

Still another feature or aspect of an embodiment is believed at the time of the filing of this patent application to possibly reside broadly in the device, comprising at least two pretreatment zones 11, 12; 24, 25 and/or at least two main treatment zones 13, 14; 26, 27.

A further feature or aspect of an embodiment is believed at the time of the filing of this patent application to possibly reside broadly in the device, comprising a temperature control system for the temperature-controlled warming of the containers in the at least one pretreatment zone 11, 12; 24, 25.

Another feature or aspect of an embodiment is believed at the time of the filing of this patent application to possibly reside broadly in the device, wherein adjacent to the at least one pretreatment zone 24, 25 is at least one sensor 28 which measures the temperature of the containers 1 to regulate the temperature of the pretreatment.

Yet another feature or aspect of an embodiment is believed at the time of the filing of this patent application to possibly reside broadly in the device, wherein for the control of the amount of treatment medium discharged onto the containers 1 in the at least one pretreatment zone 11, 12, 24, 25 and/or in the at least one main treatment zone 13, 14; 26, 27 as a function of the ratio "containers 1 with labels 2/containers 1 without labels 2".

Another feature or aspect of an embodiment is believed at the time of the filing of this patent application to possibly reside broadly in the device, wherein in the direction of transport A of the containers 1, upstream of the at least one main treatment zone 26, 27, there is at least one sensor unit, for example at least one camera of an image processing or recognition system 32, 36, to determine the ratio "containers 1 with labels 2/containers 1 without labels (2)".

Yet another feature or aspect of an embodiment is believed at the time of the filing of this patent application to possibly reside broadly in the device, wherein the conveyor line formed by the at least one conveyor 10, 43, 44 is realized for a single-file flow of containers.

Still another feature or aspect of an embodiment is believed at the time of the filing of this patent application to possibly reside broadly in the device, wherein the conveyor line formed by the at least one conveyor 10, 43, 44 is realized for a multiple-file flow of containers.

A further feature or aspect of an embodiment is believed at the time of the filing of this patent application to possibly reside broadly in the device, wherein means are provided, upstream of the at least one pretreatment zone 11, 12; 24, 25 in the direction of transport A of the containers 1 to place the containers 1 at a distance from one another in the direction of transport A.

Another feature or aspect of an embodiment is believed at the time of the filing of this patent application to possibly reside broadly in the device, wherein underneath the conveyor line 42 for the containers 1 in the at least one pretreatment zone and/or in the at least one main treatment zone means 51, 51.1 are provided for the discharge of a treatment medium on the containers 1.

Yet another feature or aspect of an embodiment is believed at the time of the filing of this patent application to possibly reside broadly in the device, wherein the conveyor line 42 for the containers 1 is formed over at least part of the length of the at least one pretreatment zone and/or of the at least one main treatment zone by clamping jaw conveyors 43, 44.

Some examples of cameras and inspection devices or systems and components thereof for bottling and container filling plants that may possibly be utilized or adapted for use in at least one possible embodiment may possibly be found in the following U.S. patents: U.S. Pat. No. 7,331,152, entitled "Beverage bottling plant for filling beverage bottles having a beverage bottle orientation and positioning arrangement;" U.S. Pat. No. 7,330,251, entitled "Method and apparatus for producing reference image in glass bottle inspecting;" U.S. Pat. No. 7,329,855, entitled "Optical inspection of glass bottles using multiple cameras;" U.S. Pat. No. 7,321,679, entitled "Machine for inspecting glass bottles;" U.S. Pat. No. 7,256,389, entitled "Glass bottle inspection machine;" U.S. Pat. No. 7,182,115, entitled "Beverage bottling plant for filling bottles with a liquid beverage filling material having a container filling plant container information adding station, such as, a labeling station, configured to add information to containers, such as, bottles and cans, and modules for labeling stations and a bottling plant having a mobile module carrier;" U.S. Pat. No. 7,057,718, entitled "Device and method for inspecting the transparent bottoms of bottles;" U.S. Pat. No. 7,013,624, entitled "Beverage bottling plant for filling bottles with a liquid beverage filling material, a container filling plant container information adding station, such as, a labeling station, configured to add information to containers, such as, bottles and cans, and modules for labeling stations;" U.S. Pat. No. 6,912,303, entitled "Method for testing the reliability of a testing apparatus, especially an empty bottle inspector;" and U.S. Pat. No. 6,834,473, entitled "Bottling plant and method of operating a bottling plant and a bottling plant with sections for stabilizing the bottled product."

Some examples of radiant or microwave heating of labels for bottling and container filling plants that may possibly be utilized or adapted for use in at least one possible embodiment may possibly be found in the following U.S. patents: U.S. Pat.

No. 7,010,900, entitled "Beverage bottling plant for filling bottles with a liquid beverage filling material, and a cleaning device for cleaning bottles in a beverage bottling plant;" and U.S. Pat. No. 6,971,219, entitled "Beverage bottling plant for filling bottles with a liquid beverage filling material and a labelling station for labelling filled bottles and other containers."

The purpose of incorporating U.S. patents, foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the International Search Report dated Aug. 14, 2008, and/or cited elsewhere are hereby incorporated by reference as if set forth in their entirety herein as follows: DE 24 60 175 A1, published on Jul. 15, 1976, having the German title "VERFAHREN UND VORRICHTUNG ZUR VORBEHANDLUNG VON MEHRWEGBEHAELTERN;" DE 85 06 654 U1, published on May 15, 1985, having the German title "VORRICHTUNG ZUM ABLOESEN EINES ETIKETTS;" and U.S. Pat. No. 4,715,920, published on Dec. 29, 1987, and having the English title "APPARATUS AND METHOD FOR RECYCLING PLASTIC BEVERAGE CONTAINERS."

The purpose of incorporating U.S. patents, foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 017 407.0, filed on Apr. 13, 2006, having inventors Iris SCHILLER, Jan NIELEBOCK, Bernd MOLITOR, and Falk DITTRICH, and DE-OS 10 2006 017 407.0 and DE-PS 10 2006 017 407.0, and International Application No. PCT/EP2007/002994, filed on Apr. 3, 2007, having WIPO Publication No. WO2007/118606 and inventors Iris SCHILLER, Jan NIELEBOCK, Bernd MOLITOR, and Falk DITTRICH, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/002994 and German Patent Application 10 2006 017 407.0 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/002994 and German patent application 10 2006 017 407.0 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

NOMENCLATURE

1 Bottle
2 Label
3 Bottle cell
4 Bottle basket
5 Cleaning machine
5.1 Container inlet
5.2 Container outlet
6, 7 Conveyor line
8, 8*a* Device
8.1, 8.2 Section of the device
9 Conveyor line
10 Conveyor inside the device
11, 12, 13, 14 Treatment zone
15, 16 Nozzle head
17 Collecting basin
17.1 Water feed to the collecting basin 17
18 Drain
19 Screen
20 Collecting chamber
21 Screen
22 Pump
23 Heater
24, 25, 26, 27 Treatment zone
28 Sensor unit
29 Control unit
30, 31 Control valve
32 Image processing
33 Control valve
34 Nozzle
35 Sensor unit
36 Image processing
37 Control valve
38 Nozzle

39 Control valve
40 Nozzle
41 Treatment zone
42 Conveyor line
43, 44 Clamping jaws conveyor
45 Belt
45.1 Length
46, 47 Roller
48 Drive mechanism
49 Nozzle head or spray tube
49.1 Nozzle
50 Spray tube
50.1 Nozzle
51 Spray tube
51.1 Nozzle
A Direction of transport of the bottles 1 by the device 8 or 8*a*
B, C Direction of circulation of the belts of the clamping jaw conveyor 43 or 44

What is claimed is:

1. A method of removing self-adhesive labels from return containers, comprising bottles or similar containers, to be cleaned in a container cleaning machine, said method comprising the steps of:

moving return containers labeled with self-adhesive labels into a preheating zone of a label removing machine and preheating the return containers by one of (A) and (B):

(A) spraying the return containers with a heated liquid at a temperature sufficient to heat and soften the label adhesive; and (B) emitting radiant energy sufficient to heat and soften the label adhesive; and moving the preheated return containers into a main heating zone of the label removing machine and then spraying the return containers with a heated liquid at a temperature sufficient to further heat and soften the label adhesive, and with a spraying force sufficient to remove the labels.

2. The method according to claim 1, wherein said step of preheating the return containers is temperature-controlled, and in a treatment zone adjacent to the preheating zone there is at least one sensor which measures the temperature of the return containers for a temperature regulation of the preheating.

3. The method according to claim 2, wherein the amount of heating in the preheating zone and/or in the main treatment zone is controlled as a function of the ratio of the number of return containers with labels to the number of return containers without labels.

4. The method according to claim 3, wherein in the direction of transport of the return containers, upstream of said preheating and main heating zones, there is at least one sensor unit, such as at least one camera of an image processing or detection system, configured to determine the ratio of the number of return containers with labels to the number of return containers without labels.

5. The method according to claim 4, wherein each of said preheating step and said main heating step comprises solely spraying return containers with hot water at a temperature in the range of between 90° C. and 100° C., or at a temperature of approximately 95° C.

6. The method according to claim 5, wherein:

the step of spraying the return containers in said main treatment zone comprises high pressure spraying using surge-type jets; and in the preheating zone and in the main heating zone, the return containers are standing upright and are contacted with the heated liquid from above and/or from the side.

7. The method according to claim 6, wherein said heated liquid is applied to the external surface of the return containers for the removal of the labels at least partly tangentially or at an acute angle.

8. The method according to claim 7, wherein:

in the preheating zone and the main treating zone, the return containers are moved by a conveyor;

at least one of the preheating zone and the main treating zone is divided into at least two treatment zones; and the return containers that are fed via the conveyor in a single-file or multi-file return container flow are placed at a distance from one another in a section of the conveyor or of a device that precedes the preheating zone so that each return container is at a distance from one another during preheating and main heating.

9. The method according to claim 8, wherein the return containers in the preheating zone and/or in the main heating zone are held between at least two clamping jaw conveyors to permit spraying with a heated liquid from below.

10. The method according to claim 1, wherein said preheating step comprises preheating return containers using radiant energy comprising one of: infrared or electromagnetic radiation, such as in the microwave range.

11. A label removing arrangement for performing the method of claim 1 of removing a self-adhesive labels from return containers, said label removing arrangement comprising:

a preheating zone, a main heating zone, and a conveyor being configured to move return containers that are labeled with self-adhesive labels first through said preheating zone and then through said main heating zone;

a preheating arrangement being disposed in said preheating zone and being configured to preheat the return containers, said preheating arrangement comprising one of (A) and (B):

(A) a spraying arrangement configured to spray the return containers with a heated liquid at a temperature sufficient to heat and soften the label adhesive; and (B) an radiant energy arrangement configured to emit radiant energy sufficient to heat and soften the label adhesive;

and a main spraying arrangement being disposed in said main heating zone and being configured to spray the return containers with a heated liquid at a temperature sufficient to further heat and soften the label adhesive, and with a spraying force sufficient to remove the labels.

12. The label removing arrangement according to claim 11, further comprising a temperature control system configured to control the temperature of the preheating of return containers in said preheating zone.

13. The label removing arrangement according to claim 12, further comprising at least one sensor configured to measure the temperature of the return containers in a treatment zone adjacent to the preheating zone for the temperature regulation of the preheating.

14. The label removing arrangement according to claim 13, further comprising a control system configured to control the amount of heating in the preheating zone and/or in the main treatment zone as a function of the ratio of the number of return containers with labels to the number of return containers without labels.

15. The label removing arrangement according to claim 14, further comprising at least one sensor unit, such as at least one camera of an image processing or detection system, disposed upstream of said preheating and main heating zones in the direction of transport of the return containers, and configured to determine the ratio of the number of return containers with labels to the number of return containers without labels.

16. The label removing arrangement according to claim 15, wherein:

said preheating arrangement comprises spray nozzles configured to spray heated water;

said main heating arrangement comprises a plurality of high pressure spray nozzles configured to spray heated water;

said conveyor is configured to support the return containers in an upright position in said preheating zone and in said main heating zone; and said spray nozzles are configured to spray the return containers with heated water from above and/or from the side.

17. The label removing arrangement according to claim 16, wherein said spray nozzles are configured to spray the heated water to the external surface of the return containers for the removal of the labels at least partly tangentially or at an acute angle.

18. The label removing arrangement according to claim 17, wherein:

at least one of the preheating zone and the main treating zone is divided into at least two treatment zones; and the return containers that are fed via the conveyor in a single-file or multi-file return container flow are placed at a distance from one another in a section of the conveyor or of a device that precedes the preheating zone so that each return container is at a distance from one another during preheating and main heating.

19. The label removing arrangement according to claim 18, further comprising:

at least two clamping jaw conveyors configured to hold and move the return containers in the preheating zone and/or in the main heating zone; and another spray arrangement disposed underneath said return containers and configured to spray return containers held by said at least two clamping jaw conveyors from below.

20. The label removing arrangement according to claim 11, wherein said preheating arrangement is configured to emit radiant energy comprising one of: infrared or electromagnetic radiation, such as in the microwave range.

* * * * *